US008357020B2

(12) United States Patent
Hansbro

(10) Patent No.: US 8,357,020 B2
(45) Date of Patent: Jan. 22, 2013

(54) LIFE JACKET

(76) Inventor: Jason Hansbro, Sylacauga, AL (US)

( * ) Notice: Subject to any disclaimer, the term of this patent is extended or adjusted under 35 U.S.C. 154(b) by 0 days.

(21) Appl. No.: 13/542,495

(22) Filed: Jul. 5, 2012

(65) Prior Publication Data

US 2012/0282832 A1 Nov. 8, 2012

Related U.S. Application Data

(63) Continuation-in-part of application No. 12/948,512, filed on Nov. 17, 2010, now abandoned.

(51) Int. Cl.
*B63C 9/08* (2006.01)

(52) U.S. Cl. ..... 441/106; 441/108; 224/148.2

(58) Field of Classification Search ..... 441/106, 441/108, 80; 224/148.2
See application file for complete search history.

(56) References Cited

U.S. PATENT DOCUMENTS

| | | | | |
|---|---|---|---|---|
| 5,816,457 | A * | 10/1998 | Croft | 224/148.2 |
| 6,237,152 | B1 * | 5/2001 | Gootrad | 2/87 |
| 6,314,579 | B1 * | 11/2001 | Marcon | 2/102 |
| 6,328,618 | B1 * | 12/2001 | Fleischli | 441/106 |
| 6,654,963 | B2 * | 12/2003 | Fayle et al. | 2/84 |
| 7,053,822 | B2 * | 5/2006 | Rickerson, Jr. | 342/357.54 |
| 2002/0124299 | A1 * | 9/2002 | Malcolm | 2/439 |
| 2007/0181616 | A9 * | 8/2007 | Horito et al. | 224/148.2 |
| 2008/0067202 | A1 * | 3/2008 | Silva et al. | 224/148.2 |

* cited by examiner

*Primary Examiner* — Stephen Avila

(57) ABSTRACT

A life jacket includes a hood and a hydration pack. The hood may be neoprene protecting the head from the water. The hydration pack may be insulated. The hydration pack may include a flow tube with a filter providing clean water to the user. The life jacket may include waterproof insulated pockets protecting contents therein.

1 Claim, 8 Drawing Sheets

LIFE JACKET

CROSS-REFERENCE TO RELATED APPLICATIONS

This application is a Continuation-In-Part of U.S. patent application Ser. No. 12/948,512 filed Nov. 17 2010 now abandoned, which is hereby incorporated by reference herein in its entirety.

BACKGROUND OF THE INVENTION

The present invention generally relates survival gear and more particularly, a life jacket.

The use of emergency position indicating radio beacons for locating personnel stranded at sea or on land are well known in the prior art. Typically, the device is battery powered, compact, and when turned on, a device will transmit radio waves at predetermined frequencies, typically 121.5 MHz and 243 MHz, which are guard channels that are listened to for emergency situations. By sending out an emergency signal at these frequencies, the Coast Guard and other surrounding people who are alerted to the guard channels are aware of the emergency and can use the frequency transmissions for locating the downed personnel.

However, transmission of the beacon merely provides a signal that requires triangulation by emergency craft. The need to hone-in on a signal, without further information, may cause delay because of the lack of more exacting location information.

Additionally, when stranded at sea, one is exposed to a multitude of environmental hazards. Aside from drowning, a stranded individual may risk harm from being exposed to the water itself. Hypothermia can set in when extremities are exposed to water temperatures below cord body temperature over a prolonged period. Additionally, salt water may draw water from exposed skin leading to potential dehydration.

As can be seen, there is a need for a more exacting location system for water-born survivors, and a hydration system. It can also be seen that a need exists for a life jacket that protects an individual from prolonged exposure to the elements.

SUMMARY OF THE INVENTION

In one aspect of the present invention, a life jacket, comprises a vest; and a deployable hood attached to the vest.

In another aspect of the present invention, a life jacket, comprises a vest filled with buoyant foam; a bladder; a hydration pack attached to the vest, wherein the hydration houses the bladder, and wherein the hydration pack is lined with insulation insulating the bladder from the hydration pack; a flow tube attached to the bladder; and a filter disposed within the flow tube.

In yet another aspect of the present invention, a life jacket, comprises a vest filled with buoyant foam; a neoprene hood attached to the vest; a hydration pack attached to the vest; a flow tube connected to the hydration pack; and a filter disposed in the flow tube.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a hydration system and life vest or life jacket within a single unit with a built-in waterproof personal locator.

Figure 1:
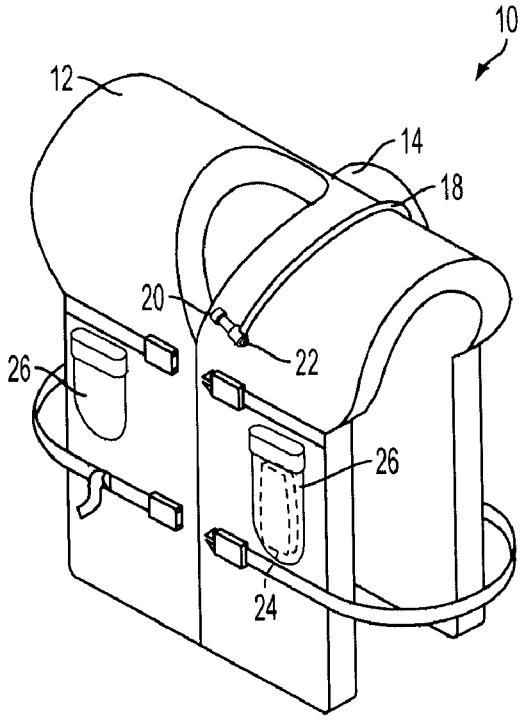
FIG. 1 is a perspective view of a hydration system and life jacket with a built-in waterproof personal locator according to one embodiment.

With reference to FIG. 1, a perspective view of a personal water safety system 10 is shown according to one embodiment. The system may have hydration pack 14 and a life vest 12 with a built-in waterproof personal locator 24.

In one embodiment, the hydration pack 14 may be attachable to the rear portion of the life vest 12. A flow tube 18 may extend from the hydration pack 14 with enough length to allow for easy reach to the mouth of a user. A waterproof pocket 26 may be included to hold the personal locator 24, and protect electronics used by the personal locater 24 from water and the elements. In one embodiment two waterproof pockets 26 may be provided to allow for additional storage of food or other articles that the user wishes to keep dry.

In one embodiment, a mouthpiece 18 may be attached to the flow tube 18. The mouthpiece 18 may comprise a rigid tubular body glued to, or formed with, the flow tube 18, which may fit in the user's mouth and allows suction of liquid by the user from the hydration pack 14. An on/off valve 22 may allow the user to close off the mouthpiece from flow of liquid when the user is not drinking from the hydration pack. When in the closed or off position, the on/off valve 22 may prevent leakage from the hydration pack 14 during non-use of the life vest 12, and may prevent back-flow or salt water intrusion during use of the life vest 12 when the user is not drinking from the hydration pack 14.

Figure 2:
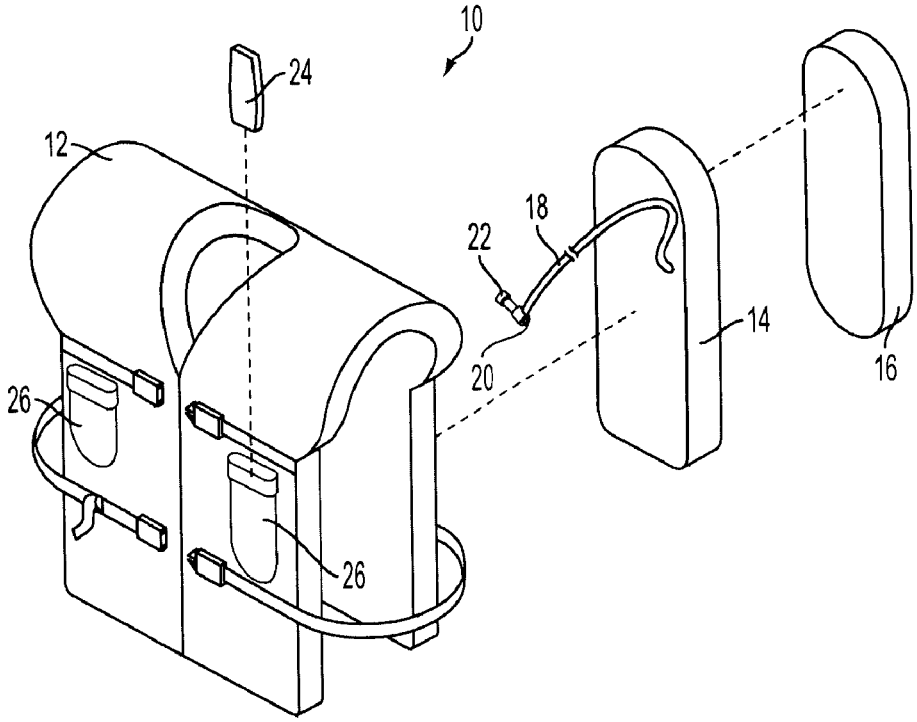
FIG. 2 is an exploded perspective view of the embodiment of FIG. 1.

With reference to FIG. 2, an exploded perspective view of the embodiment of FIG. 1 is shown. A bladder bag 16 may be used to fit within the hydration pack 14, which may shrink as liquid is drawn from the hydration pack 14 by the user. The bladder bag 16 used in this way may prevent accumulation of air so that the user may have a steady flow of liquid during use of the hydration pack 14.

The personal locater 24 may comprise a combination global positioning system (GPS) locator and transmitter. The GPS portion of the personal locater 24 may determine GPS coordinates of the user from the well-known GPS system currently in use World-Wide. In one embodiment, the GPS coordinates are constantly transmitted in regular intervals by the transmitter portion of the personal locator to be received by rescue personnel. The rescue personnel may then input the received coordinates into rescue aircraft or watercraft GPS guidance systems to guide them to the user wearing the life vest 12. GPS tracking devices that transmit location information are widely available for use as the personal locater with the system 10, including the FAST FIND GPS personal locator, available from McMurdo Ltd. of Portsmouth, United Kingdom.

Figure 3:
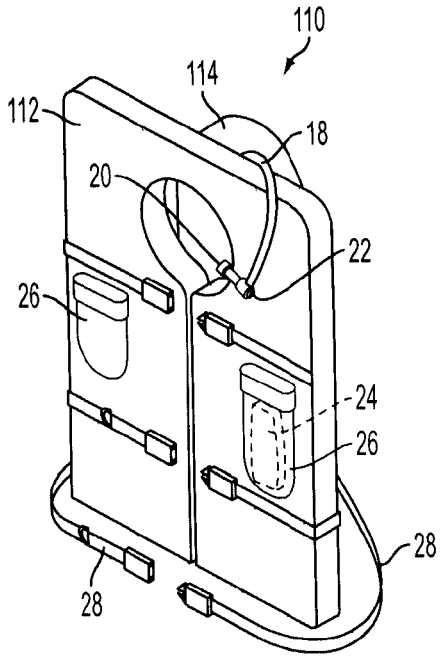
FIG. 3 is a perspective view of a hydration system and life jacket with a built-in waterproof personal locator according to an alternate embodiment.

With reference to FIG. 3, a perspective view of an alternate embodiment of a personal water safety system 110, comprising the hydration pack 114 and life vest 112 with the personal locator 24 is shown. The embodiment of FIG. 3 may comprise a one panel life vest 112, with the hydration pack 114 forming a back panel. A waist strap 28 may be included to secure the user between the life vest 112 panel and the hydration pack 114. The waterproof pockets 26, with the personal locator 24, may be attached to the front panel of the life vest 112.

Figure 4:
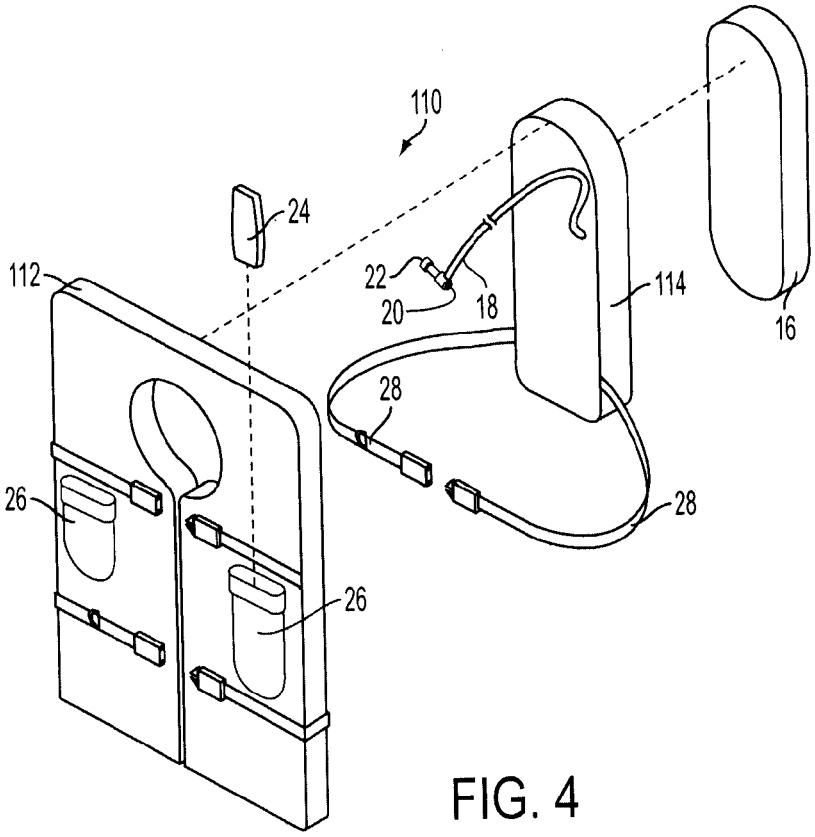
FIG. 4 is an exploded perspective view of the embodiment of FIG. 3.

FIG. 4 is an exploded perspective view of the embodiment of FIG. 3. As with the embodiment of FIG. 1, a bladder bag 16 may be used to fit within the hydration pack 114. However, the hydration pack 114 may have one portion of the strap 28 attached to the bottom right side, and another portion of the strap 28 attached to the bottom left side, in such a way that the strap 28 may fit around the waist of the user. The top of the hydration pack 114 may be attached to the top of the life vest 112 such that the life vest 112 may fit over the user's head to bend over the user's chest, and wherein the hydration pack 114 may abut the back of the user.

Figure 5:
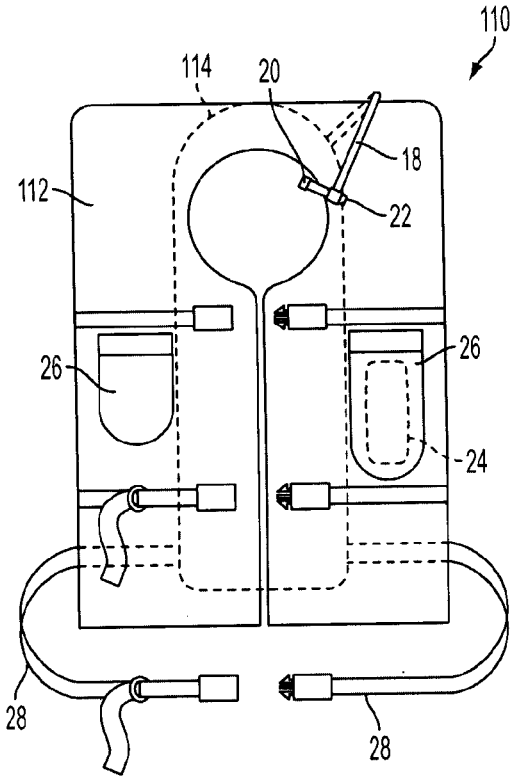
FIG. 5 is a front view of the embodiment of FIG. 3.

With reference to FIG. 5, a front view of the embodiment of FIG. 3 is shown with the hydration pack 114 shown in phantom behind the life vest 112. As shown in FIG. 5, the strap 28 may be able to reach around the user's waist.

Figure 6:
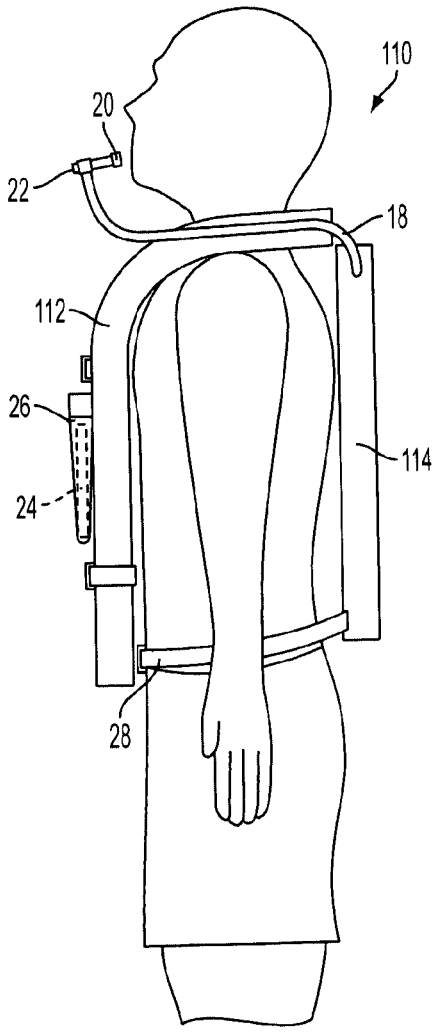
FIG. 6: is a side view of the embodiment of FIG. 3.

With reference to FIG. 6, a side view of the embodiment of FIG. 3 is shown being worn by a user. The strap 28 is shown around the waist of the user and buckled in the front of the user behind the bottom portion of the life vest 112. The side of the pocket 26 is shown, with the personal locater inside the pocket 26 shown in phantom.

Figure 7:
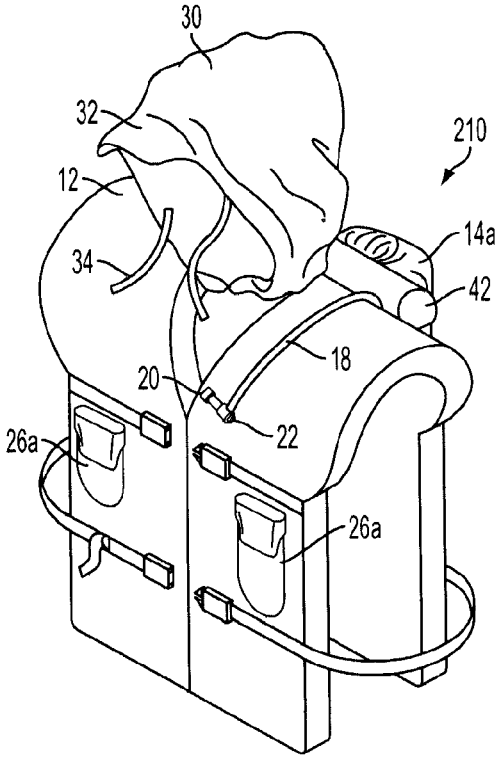
FIG. 7 is a perspective view of a life jacket according to another embodiment.
Figure 8:
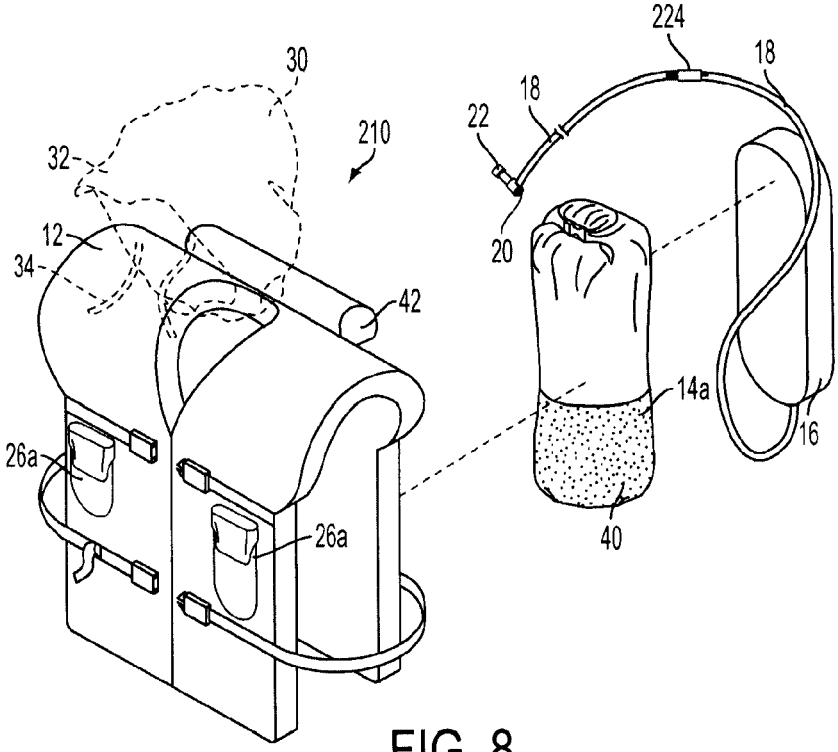
FIG. 8 is an exploded perspective view of the life jacket of FIG. 7.
Figure 9:
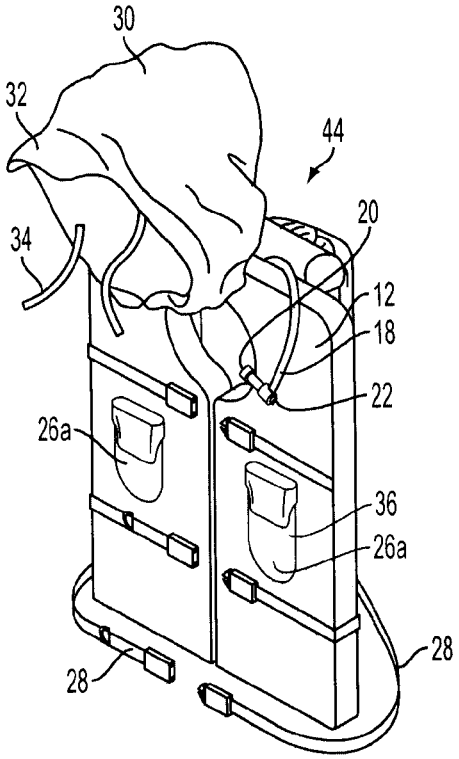
FIG. 9 is a perspective view of a life jacket according to yet another embodiment.
Figure 10:
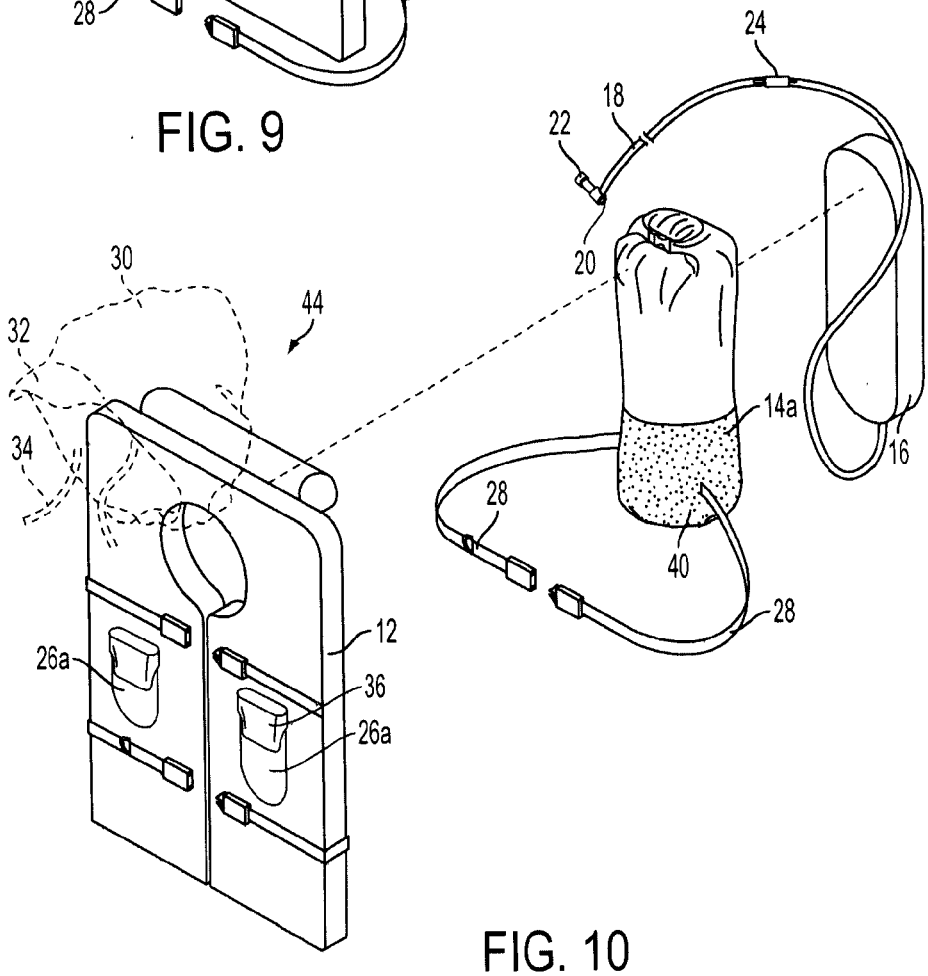
FIG. 10 is an exploded perspective view of the life jacket of FIG. 9.
Figure 11:
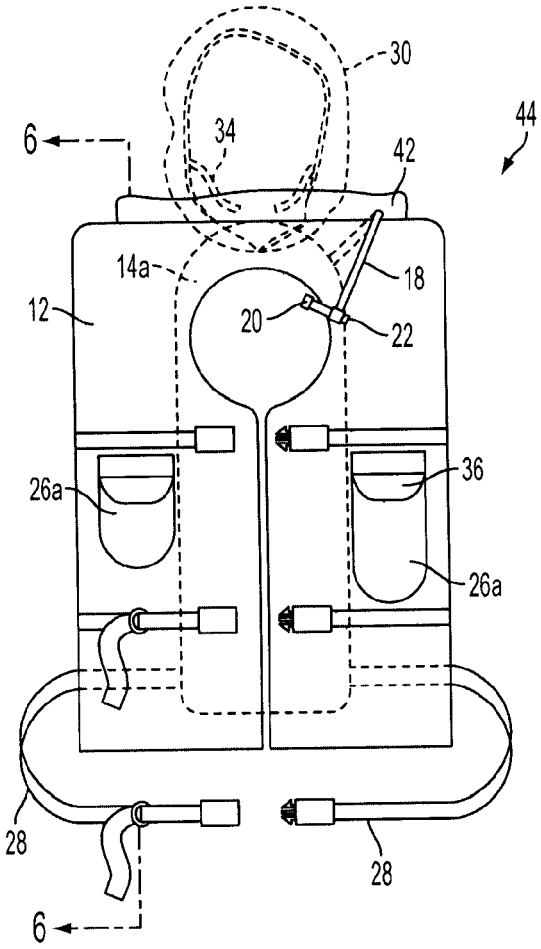
FIG. 11 is a front view of the life jacket of FIG. 9.

Referring now to FIGS. 7-8, a life jacket 210 is shown according to another exemplary embodiment of the present invention. FIGS. 9-11 show a lifejacket 44 according to yet another exemplary embodiment of the present invention. Lifejacket 44 is similar to lifejacket 210 except that the vest 12 of lifejacket 210 is of the dual panel variety while vest 12 of the lifejacket 44 is a single panel type. For sake of illustration, the remaining description will be discussed with reference to lifejackets 44 and 210 simultaneously.

Referring now to FIGS. 7-13, features common to the life jacket (44, 210) and the personal water safety system (10, 110) (FIGS. 1-6) are shown with corresponding numbers. The previously described features of elements common to the embodiments of systems (10, 110) and the lifejackets (44, 210) will not be repeated and will be understood as incorporated into lifejackets (44, 210) herein. The life jackets 44, 210 may be configured to satisfy Type I, Type II, and Type Ill categories of personal floatation devices. For example, the vest 12 may be filled with buoyant foam that has an inherent buoyancy of approximately 22 pounds.

The lifejackets 44, 210 may also include a deployable hood 30. The hood 30 may be made from neoprene. The hood 30 may be stowed within a pouch 42 when deployed. The pouch 42 may be positioned on a rear shoulder blade of the life vest 12. When storing the hood 30, the pouch 42 may be a bundled roll positioned to protect the rear base of a user's head. The hood 30 may include adjustable straps 34 configured to widen and constrict the hood 30 for placement over the user's head. A brim 32 may be incorporated onto the hood 30 to shade the user's face from the sun. The brim 32 may be rigid or limp.

Figure 12:
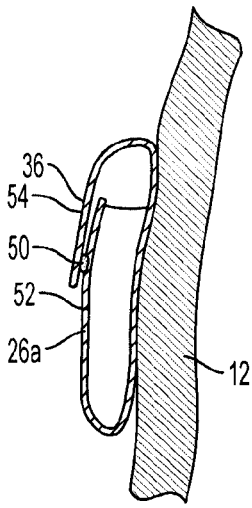
FIG. 12 is a cross-sectional detail view along line 6-6 of FIG. 11.

The lifejackets 44, 210 may also include waterproof pockets 26*a*. The pockets 26*a* may be lined with insulation, for example, with polyethylene, urethane, or styrofoam. Referring to FIG. 12, the pockets 26*a* may include a thick plastic lining 52. A plastic zipper 50 may seal a flap 36 over the pocket interior. The exterior of the pockets 26*a* may have a reflective coating 54. In some embodiments, an exterior zipper (not shown) attached to a drawstring (not shown) may seal the flap 36 interior and the plastic zipper 50 off from the elements.

Figure 13:
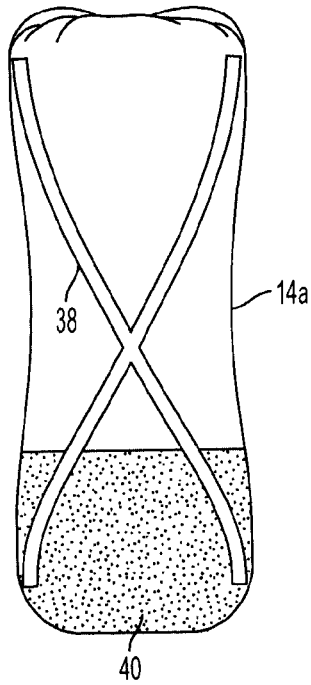
FIG. 13 is a rear view of an exemplary hydration pack used in embodiments shown in FIGS. 7-11.
Figure 14:
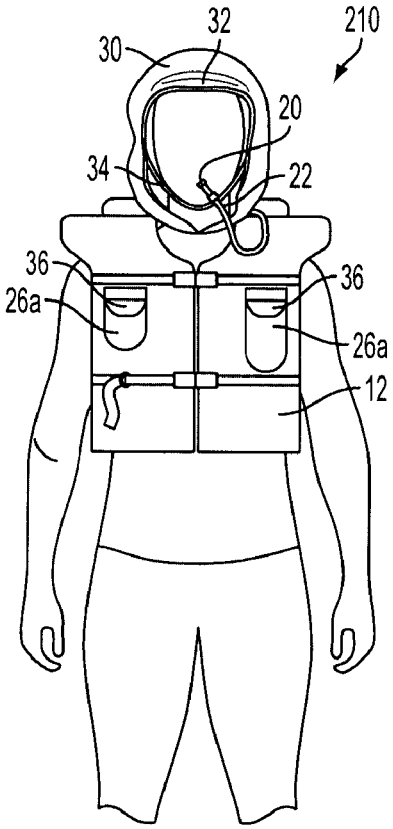
FIG. 14 is a front view of the life jacket of FIG. 7.
Figure 15:
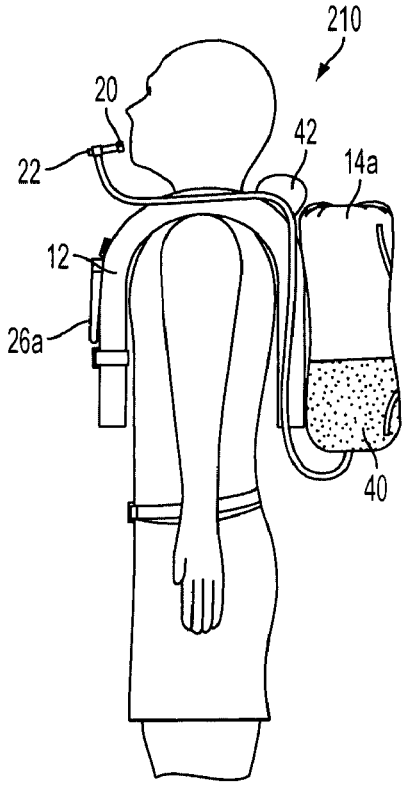
FIG. 15 is a side view of the life jacket of FIG. 7.
Figure 16:
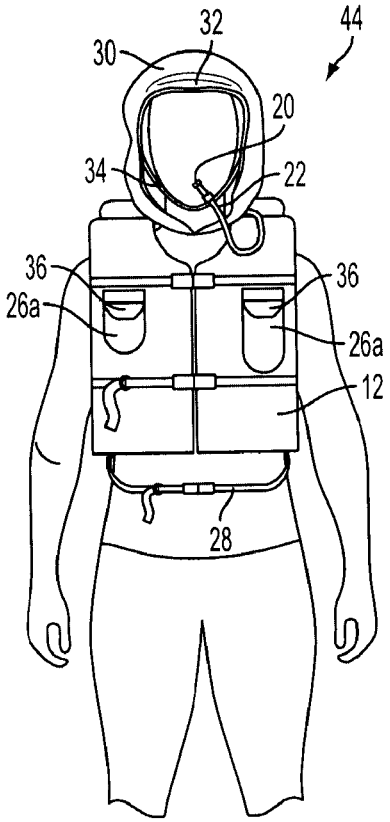
FIG. 16 is a front view of the life jacket of FIG. 9.
Figure 17:
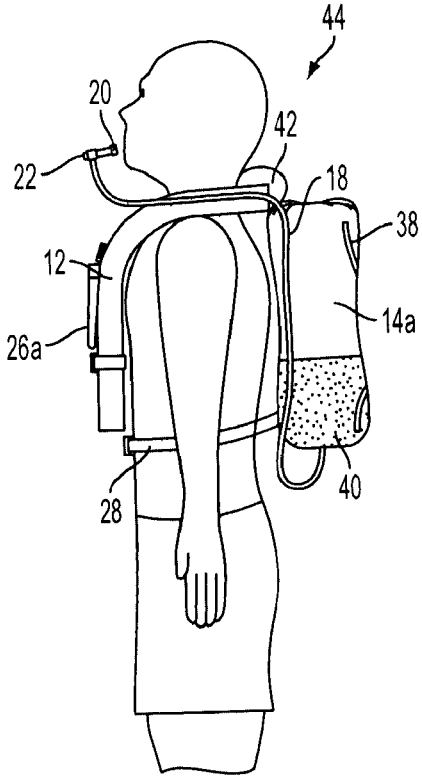
FIG. 17 is a side view of the life jacket of FIG. 9.

A hydration pack 14*a* may provide clean hydration to the user. The bladder 16 may hold, for example, up to 80 ounces of fluid. The hydration pack 14*a* may be lined with insulation, for example, with polyethylene, urethane, or styrofoam, insulating the bladder 16 from the hydration pack 14*a* and external heat. The hydration pack 14*a* may also be water proof preventing excess water from entering the pack potentially weighing the jacket vest 12 down. A reinforcement rubber lining 40 may surround a base of the hydration pack 14*a* providing protection from damage and further insulating the base of the hydration pack 14*a*. In an exemplary embodiment, the flow tube 18 may include a filter 224. The filter 224 may be configured to prevent particulates from being ingested by the user. The filter 224 may be integral to the flow tube 18 or in some embodiments, the flow tube 18 may be separable so that the filter 224 is connected between segments of the flow tube. Referring to FIG. 13, reflective strips 38 may be attached to the rear of the hydration pack 14*a*. In one exemplary embodiment, the strips 38 cross to provide a visible target.

Referring now to FIGS. 14-17, the lifejackets 44, 210 may be worn as shown. In use, it may be appreciated that the neoprene hood 30 may provide water resistance and insulation to the head of the user when worn. Being neoprene, the hood 30 may keep the head relatively dry and warm when the user is floating on his or her back and the back of the head is in contact with the water. It may also be appreciated that the pockets 26*a* may protect contents from the elements. The plastic zipper 50 and lining 52 may prevent water from entering the pocket interior, which may hold, for example a GPS transponder or other electronic device as described above. The insulation on the pockets 26*a* may help prevent excessive heat (for example, from direct sunlight) from building up in the pockets, which may damage electronic contents. The reflective coating 54 of the pockets 26*a* may help insulate the pockets 26*a* by reflecting heat away. The reflective coating 54 of the pockets 26*a* may also serve as reflective beacons when the user is floating on his or her back. The insulated hydration pack may prevent drinking water from heating up or becoming too cold allowing for a pleasant drinking experience. Moreover, by controlling the water temperature, bacterial growth may be inhibited. Additionally, it may be appreciated that the filter 224 may provide potable water even if the water has been stored over prolonged periods. In embodiments where the flow tube 18 is separable, the filter 224 may be easily replaced by separating the segments of the flow tube 18 from the ends of the filter 224 and substituting in a fresh filter 224 as needed. The strips 38 on the rear of the hydration pack 14*a* may provide another reflective beacon, for example, when the user is upright or floating on his or her front.

It should be understood, of course, that the foregoing relates to exemplary embodiments of the invention and that modifications may be made without departing from the spirit and scope of the invention as set forth in the following claims.

I claim:

1. A life jacket comprising:

a vest having a front panel and a back and the vest being filled with floatation foam;

a hydration pack capable of providing hydration to a user of the life jacket with the hydration pack including an insulated bladder, filter and mouthpiece, the hydration pack further having a top and bottom, wherein the top of vest the front panel is attached to the top of the hydration pack, the hydration pack further including a flow tubes connecting the bladder to the mouthpiece with an inline filter;

a hydration pack waist strap;

a neoprene hood with brim with the hood being deployable from a rolled up configuration;

a waterproof, insulated pocket, the pocket including a sealing plastic zipper and a reflective coating.

* * * * *